US005186026A

United States Patent [19]

Teufel

[11] Patent Number: 5,186,026

[45] Date of Patent: Feb. 16, 1993

[54] COMPOUND NEEDLE

[75] Inventor: Albert Teufel, Veringenstadt, Fed. Rep. of Germany

[73] Assignee: Theodor Groz & Söhne & Ernst Beckert Nadelfabrik Commandit-Gesellschaft, Albstadt, Fed. Rep. of Germany

[21] Appl. No.: 818,818

[22] Filed: Jan. 10, 1992

[30] Foreign Application Priority Data

Jan. 15, 1991 [DE] Fed. Rep. of Germany ..... 4100931

[51] Int. Cl.[5] ..... D04B 35/06

[52] U.S. Cl. ..... 66/123; 66/120

[58] Field of Search ..... 66/120, 123, 124, 83, 66/85 R

[56] References Cited

U.S. PATENT DOCUMENTS

| | | | |
|---|---|---|---|
| 1,727,769 | 9/1929 | Haveson | 66/117 |
| 2,025,466 | 12/1935 | Lombardi | 66/123 |
| 2,165,464 | 7/1939 | Eichner | 66/123 |
| 3,584,481 | 6/1971 | Hayashi | 66/120 |
| 3,811,299 | 5/1974 | Peschl et al. | 66/120 |
| 4,089,192 | 5/1978 | Kohorn | 66/123 |
| 4,448,044 | 5/1984 | Kühnert | 66/120 |
| 4,534,187 | 8/1985 | Sawazaki et al. | 66/120 |
| 4,696,170 | 9/1987 | Tibbals, Jr. | 66/120 |

FOREIGN PATENT DOCUMENTS

| | | | |
|---|---|---|---|
| 2245731 | 3/1974 | Fed. Rep. of Germany . | |
| 3336212 | 1/1985 | Fed. Rep. of Germany | 66/124 |
| 3624038 | 1/1987 | Fed. Rep. of Germany . | |

OTHER PUBLICATIONS

*Needle Characteristics* by J. T. Speetjens, "The Hosiery Trade Journal", vol. 75, No. 891, p. 118.

*Primary Examiner*—Werner H. Schroeder
*Assistant Examiner*—Larry D. Worrell, Jr.
*Attorney, Agent, or Firm*—Spencer, Frank & Schneider

[57] ABSTRACT

A compound needle has a needle member and a two-part closing element. The needle member has a head at a front end of the needle. The closing element is mounted on the needle member so as to be longitudinally displaceable with respect to the needle member and cooperate with the head. A first part of the closing element includes a shank, a beard on the shank and an anchoring butt formed on an end region of the shank remote from the beard. A second part of the closing member follows the first part in the longitudinal direction and has a control butt and a brake spring. The second part also has a housing section which receives at least the end region of the shank. The first and second parts are undetachably and rigidly connected together in a region of the anchoring butt.

21 Claims, 5 Drawing Sheets

COMPOUND NEEDLE

REFERENCE TO RELATED APPLICATIONS

This application claims the priority of Federal Republic of Germany application Serial No. P 41 00 931.2, filed Jan. 15, 1991, which is incorporated herein by reference.

BACKGROUND OF THE INVENTION

The present invention relates to a compound needle, particularly for use in a knitting machine.

Such a compound needle is disposed for longitudinal displacement in an associated guide groove of a needle bed of the machine and includes a needle member provided with a head, and a closing element which cooperates with the head and is mounted so as to be longitudinally displaceable relative to the head. The closing element includes a shank which is provided with a beard (tip) and at least one control butt. A laterally acting brake spring is associated with the closing element and provides lateral guidance of the closing element in the vicinity of the brake spring.

In a prior art compound transfer needle of this type, a one-part (unitary) closing element is provided, rearward of its control butt, with a sc-called back shank, is disposed between two narrow spring tongues that form the brake spring.

These two spring tongues are parts of a shaped sheet metal component that also includes an approximately U-shaped yoke member connecting the two spring tongues with one another at one end. The yoke member is placed on the shank of the closing element and is fixed thereto by appropriate bending of its free ends. To prevent axial displacement of the sheet metal component relative to the closing element, the shank is provided with a small butt which is spaced from the control butt, and the component is mounted with the yoke member between the two butts, which act as axial stops.

Under certain conditions of use, it would be desirable to have better lateral guidance for the closing element in the associated groove of the needle bed of the machine in the region of the brake spring. However, for the compound needle of the prior art, this would require adjustments to be made on the closing element at the two spring tongues when the sheet metal component is installed.

SUMMARY OF THE INVENTION

It is therefore an object of the present invention to alleviate this problem and provide a compound needle, par-ticularly a compound transfer needle, with which improved guidance of the closing element in the region of the brake spring can be realized in a relatively simple manner.

The above object is accomplished according to the present invention in that a compound needle is provided which includes a needle member and a closing element, wherein the closing element is formed from two parts which are connected end-to-end. The first part of the closing element includes a shank, a beard (tip) on the shank and a coupling means on an end region of the shank remote from the beard. The second part includes a control butt, a laterally acting brake spring means, and a receiving means which receives at least the end region of the shank of the first part. The two parts are undetachably and rigidly connected with one another in a region of the coupling means.

With this two-part configuration of the closing element, the second part, including the brake spring means, can be designed independently of the first part so as to realize optimum guidance characteristics in the respective groove of the needle bed of the machine. In particular, the second part can be made very stable and can be provided with good lateral guidance in spite of the limited thicknesses of the closing element and needle member.

In a preferred embodiment, the receiving means includes a longitudinal groove into which the end region of the shank of the first part is fitted. This groove ensures accurate lateral guidance of the shank where it is connected with the second part. Moreover, the second part of the closing element can be configured to meet conditions determined by the mode of operation of the machine and the configuration of its needle bed. For example, the second part may include at least one shank or shank portion on which the control butt is disposed. Alternatively, or in addition, the second part may include a back shank following the control butt.

Advisably, in the embodiment including the above-mentioned longitudinal groove, the groove opens at one end into a first recess which is provided in the second part and which, in turn, opens toward the top or the bottom of the second part.

It has also been found to be advantageous for the coupling means to include an anchoring butt disposed on the end region of the shank of the first part. This anchoring butt is fitted into a correspondingly shaped second recess in the second part which starts at the longitudinal groove and thus substantially increases the stability of the connection. The longitudinal groove and the second recess may be formed in a section of the second part which has been shaped to form a housing. The housing section may also support the control butt.

In the region of the second recess and/or the region of the longitudinal groove, the second part may be provided with one or more openings that lead laterally into the second recess and/or the longitudinal groove. Such an opening may facilitate the establishment of a connection between the two parts of the closing element. The two parts may be undetachably connected with one another in region adjacent to the edges of the opening. For example, the anchoring butt and the second part may be wedged, welded or soldered together in this region. If necessary, to improve the connection, the anchoring butt also may be provided with undercuts, projections or other means to produce a form-locking connection with the second part.

The closing element of the compound needle according to the invention permits a very simple configuration of the brake spring means which, in a preferred embodiment, includes at least one lateral friction bend at the shank portion or back shank of the second part. For this purpose, the shank portion or back shank includes, in the region of this friction bend, a laterally disposed section of reduced thickness.

Moreover, it is of particular advantage for the second part to have a greater thickness than the first part, at least along a length portion. Often it ma be advisable for the second part to have a thickness which, at least along a length portion, corresponds approximately to the thickness of the needle member. In this way, it is possible to ensure without additional measures a substantially rotation-safe guidance of the closing element in the associated guide groove of the needle bed.

The first part of the closing element, including the beard, may be punched, or cut out of an appropriate steel band using precision cutting tool. The second part of the closing element may also be produced using a precision cutting tool that cuts the entire element. Alternatively, the second part may be produced by precision casting. In any case, an escape of the closing element, occasionally caused in the prior art by a lack of proper guidance of the brake spring in the guide groove of a needle cylinder during the loop-forming phase, is substantially eliminated by the present invention. Moreover, the friction force generated by the brake spring means in the compound needle of the invention can be set precisely without major effort.

The brake spring means may also be formed by the second part itself by connecting the shank of the first part with the second part so as to project from the second part such that longitudinal planes of symmetry of this shank and the second part laterally enclose an obtuse angle other than 180°.

DESCRIPTION OF THE PREFERRED EMBODIMENTS

Figure 1:
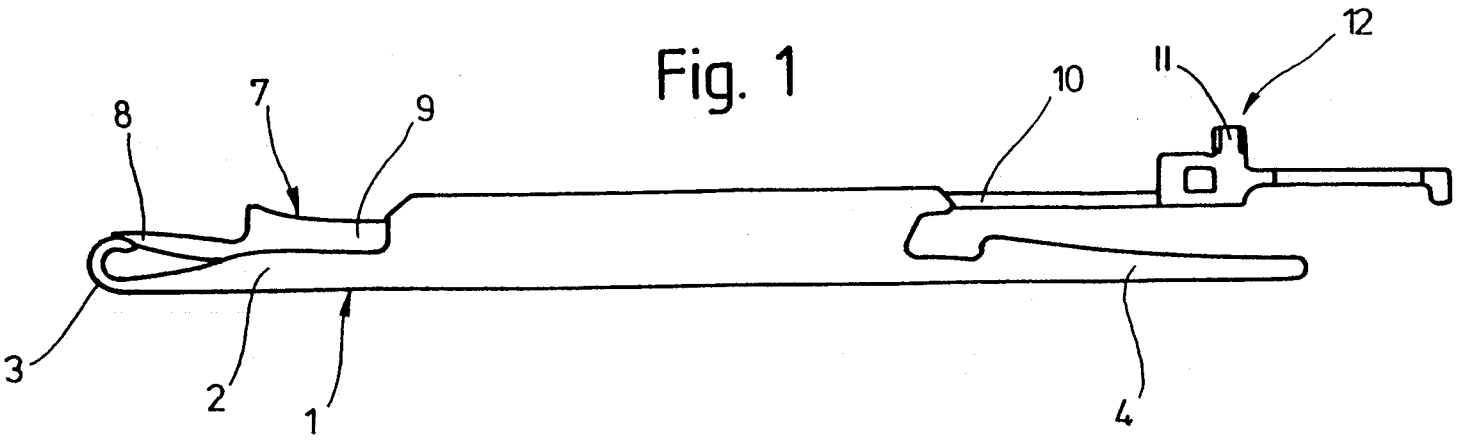
FIG. 1 is a side elevational view of a compound transfer needle according to the invention.
Figure 2:
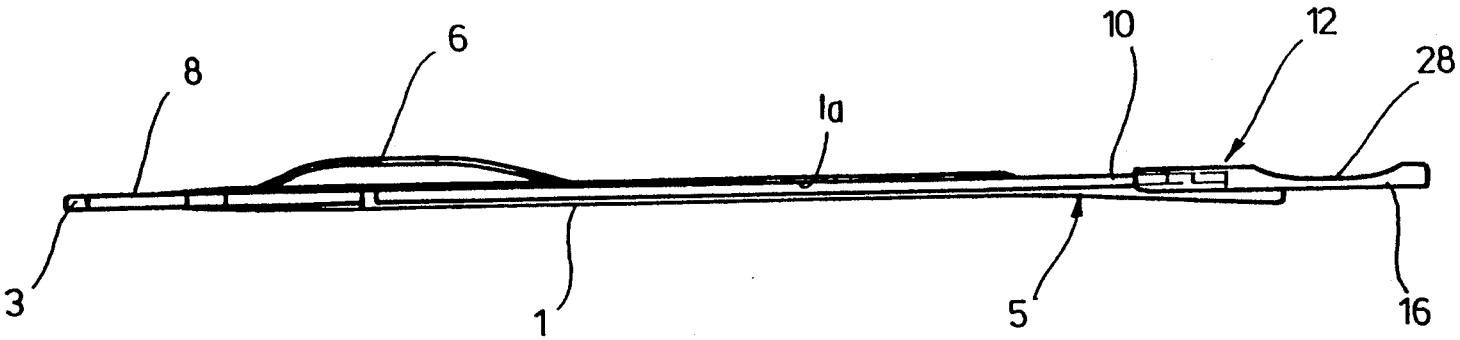
FIG. 2 is a top plan view of the compound transfer needle of FIG. 1.
Figure 3:
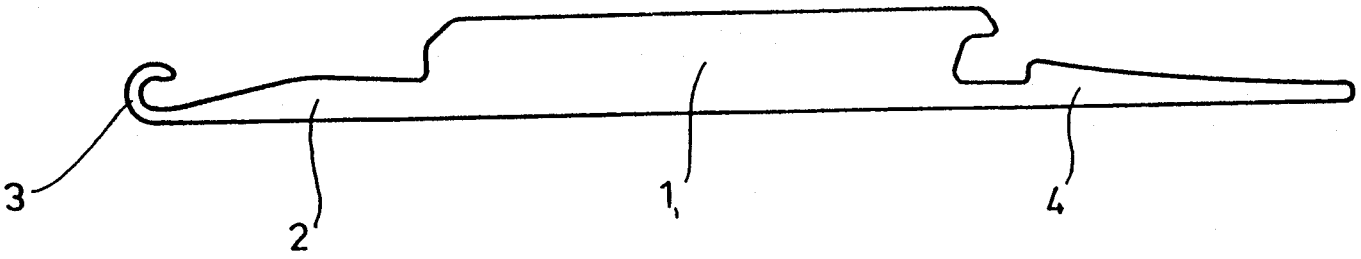
FIG. 3 is a side elevational view of the needle element of the compound transfer needle of FIG. 1.

The compound transfer needle shown in FIGS. 1 and 2 includes a flat needle member 1 which is provided at one end with a head 2 having a needle hook 3, and which is provided at the other end with a back shank 4 forming a friction bend at 5 as shown in FIG. 2. On one broadside of needle member 1, in the region of the head 2, a draw-in spring 6 is disposed as is known per se.

A closing element 7 is received for longitudinal displacement in a groove la defined by the cross-sectionally U-shaped needle member 1. One end of the closing element 7 has a beard 8 which cooperates with the needle hook 3 in the manner shown in FIG. 1. At the other end of the closing element 7 is a control butt 11 followed by a back shank 16.

Figure 4:
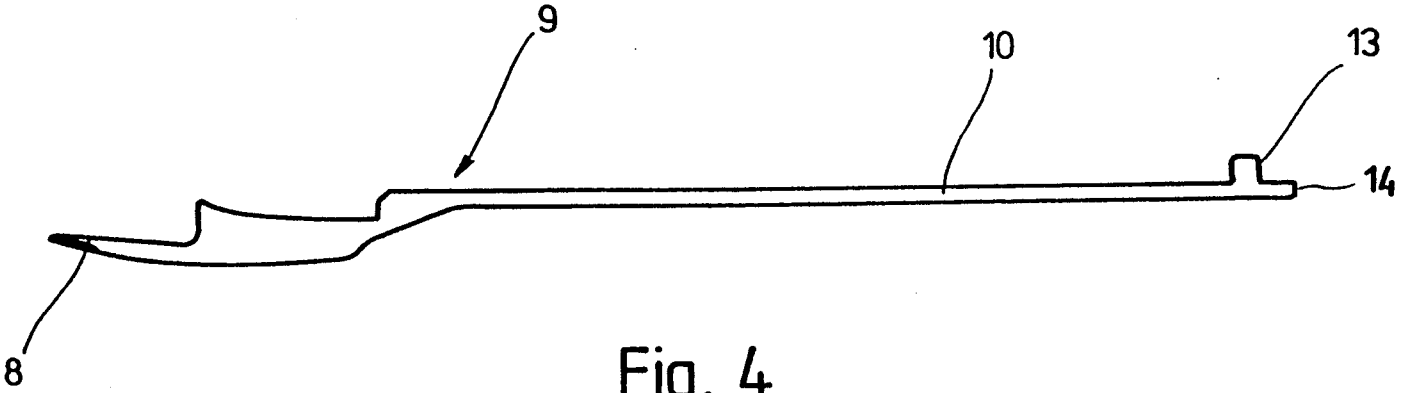
FIG. 4 is a side elevational view of the first part of the closing element of the compound transfer needle of FIG. 1.

The closing element 7 is made of two parts. A first part 9 includes the beard (tip) 8 and the shank 10 on which the beard is formed, as shown in FIG. 4. A second part 12 which includes the control butt 11 and the back shank 16, is shown in three variations in FIGS. 5–8 and 12. The two parts 9 and 12 of the closing element 7 are undetachably and rigidly connected with one another.

To effect such a connection, the upper face of the first part 9 is provided with a coupling means, preferably an anchoring butt 13, arranged at a short distance from the free rear end 14 of the shank 10. A front end of the second part 12 is shaped to form a receiving means for the coupling means. In this embodiment, the receiving means is a rectangular housing section 15 to whose upper face the control butt 11 is shaped and which is followed by the back shank 16. In the housing section 15, a symmetrical longitudinal groove 17 is provided which opens downward as shown in FIG. 10 and is symmetrical with the longitudinal center plane 7A of the closing element 7. The groove 17 extends rearwardly into a recess 18 in the back shank 16. The opening of the recess 18 is oriented downward in FIG. 9 toward the bottom of the second part 12 and is delimited at the end of back shank 16 by a guide member 19. The housing section 15 and the guide member 19 both lie on a common plane 20 containing the bottom face of the shank 10, as shown by a dashed line in FIG. 9.

Figure 5:
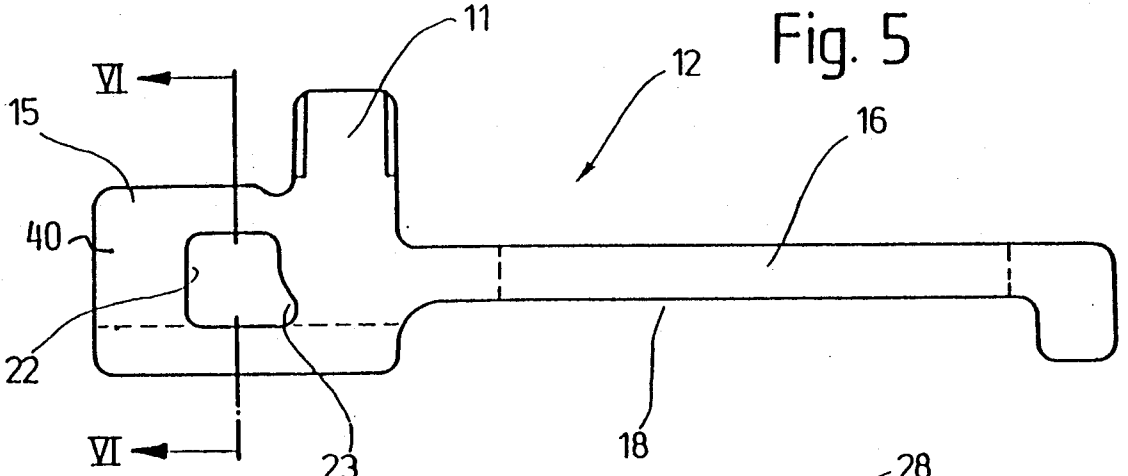
FIG. 5 is an enlarged side elevational view of the second part of the closing element of the compound transfer needle of FIG. 1.

A recess 21 having an essentially rectangular cross section (FIG. 6) is formed in the housing section 15 starting at the top of the longitudinal groove 17. The recess 21 opens laterally toward the two parallel, opposite, laterally disposed broadsides 40 of the housing section 15. The opening edges of the recess 21 are designated at 22 (FIG. 5). The recess 21 and its opening edges 22 are essentially rectangular or square. In the rearward wall of the recess 21, adjacent to the longitudinal groove 17 and approximately below the control butt 11, the recess 21 is provided with a widened portion 23 which also opens laterally into the broadsides 40.

Figure 9:
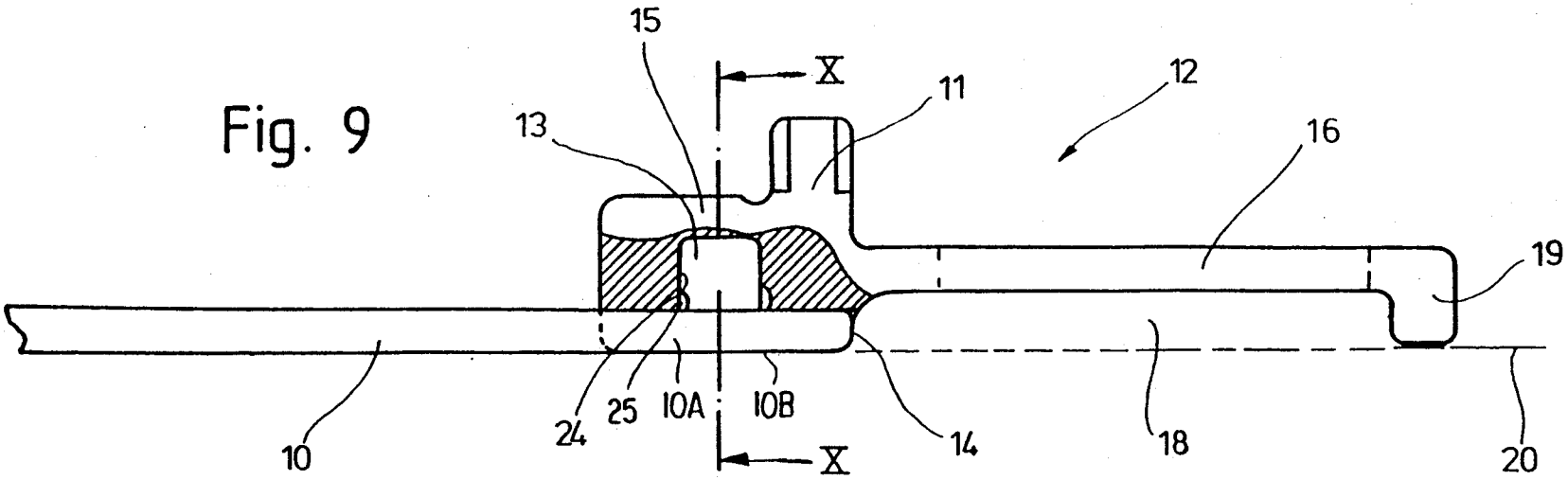
FIG. 9 is a partial enlarged sectional side elevational view of the closing element of the compound transfer needle of FIG. 1, illustrating the point of connection between the two parts of the closing element.
Figure 10:
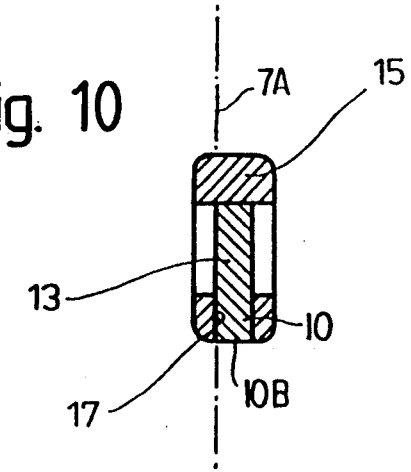
FIG. 10 is a sectional view along line X—X of FIG. 9.

The two parts 9 and 12 of the closing element 7 are produced separately, for example by precision cutting, and are joined in the manner shown in FIG. 9. For this purpose, the rear end portion 10A of the shank 10 on which the anchoring butt 13 is provided is inserted in a transitional or press fit into the longitudinal groove 17. The groove 17 has parallel sides with appropriate tolerance to receive the shank rear portion 10A, with the anchoring butt 13 being pressed into the recess 21 in a corresponding fit.

As is evident from FIGS. 9 and 10, when the parts 9, 12 of the closing element 7 are connected, the bottom face 10B of the shank 10 lies in the plane 20; that is, it is flush with the bottom face of the housing section 15.

Figure 11:
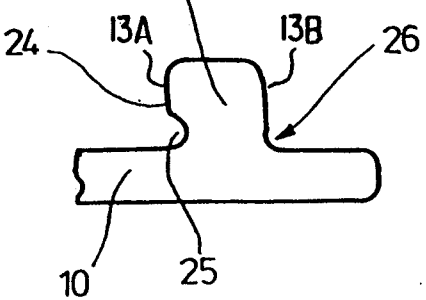
FIG. 11 is a side elevational view of the end portion of the first part of the closing element of FIG. 9 including the anchoring butt.

As is shown in FIG. 11, the front face 13A of the anchoring butt 13 is given undercuts at 24 and 25, and such an undercut also may be provided on its rear face 13B at 26; if necessary, these undercuts could also have a different shape. By virtue of undercutting the edge 24, the latter extends at an angle of slightly less than 90° (for example, 85°) to the length dimension of the shank 10. In order to realize the undetachable connection between the two parts 9 and 12, the housing section 15 of the second part 12 is wedged together with the inserted anchoring butt 13 inside the opening edges 22. As is illustrated in FIG. 9, the material of the housing section 15 is displaced as a result of the wedging to produce a form-locking connec-tion between the two parts in the region of the undercuts 24 and 25. At the same time, the longitudinal groove 17 ensures proper mutual alignment of the two parts 9 and 12 during installation.

Instead of wedging the anchoring butt 13 together with the housing section 15, the connection of the anchoring butt 13 with the housing section 15 could be effected, for example, by welding or soldering them together adjacent to the edges 22.

The housing section 15 has a closed, cage-like configuration which is accessible from the bottom through th longitudinal groove 17. By virtue of such a configuration, a high wedging force can be applied to the housing section 15 without distorting its shape. Thus, a highly stressable, undetachable connection between the two parts 9 and 12 can be ensured.

The second part 12, at least in the housing section 15, is delimited by parallel sides, and its thickness is greater than that of the shank 10 of the first part 9 and corresponds to the thickness of the needle member 1. This results in laterally disposed running or guide faces of the second part 12—and thus of the rear portion of the closing element 7 —which ensure proper guidance of the closing element 7 in the guide groove of the needle bed and prevent twisting of the closing element 7 during the loop-forming phase of use.

Figure 6:
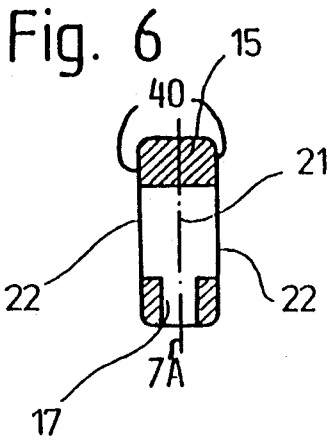
FIG. 6 is a sectional view along line VI—VI of FIG. 5.
Figure 7:
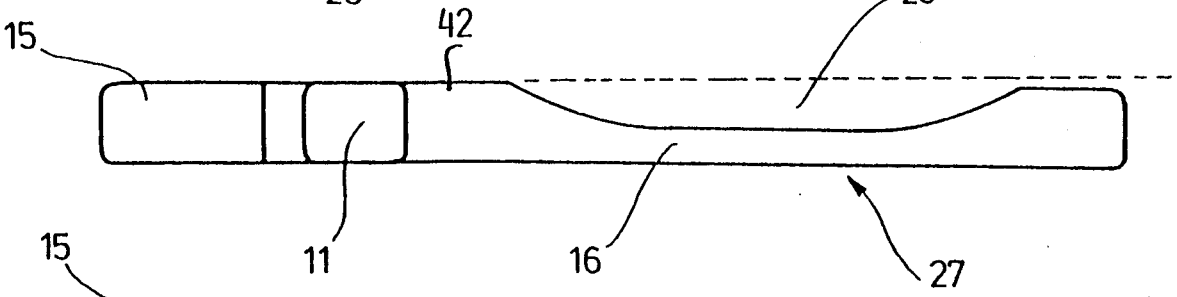
FIG. 7 is a top plan view of FIG. 5.

The second part 12 is also provided with a brake spring means which, in the embodiment according to FIGS. 5–7, is a lateral friction bend 27 formed by a laterally bent portion of the back shank 16. An elongated recess 28 is formed on one broadside 42 of +-h=back shank 16. This results in the back shank 16 having a laterally disposed section of reduced thickness in the region of the friction bend 27 and thus a corresponding improvement of the resiliency characteristics of the back shank 16 at this laterally bent portion is achieved.

Figure 8:
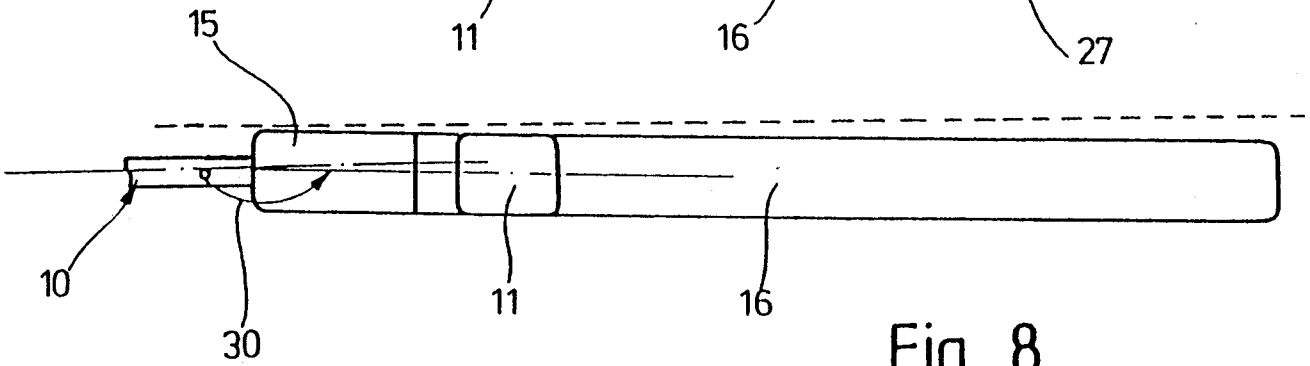
FIG. 8 is a top plan view corresponding to FIG. 7, but showing a modified embodiment of the second part of FIG. 5.

In the alternative embodiment according to FIG. 8, the second part 12 is defined by parallel sides over its entire length and the longitudinal groove 17 is provided in the housing section 15 at a correspondingly oblique orientation.

Figure 12:
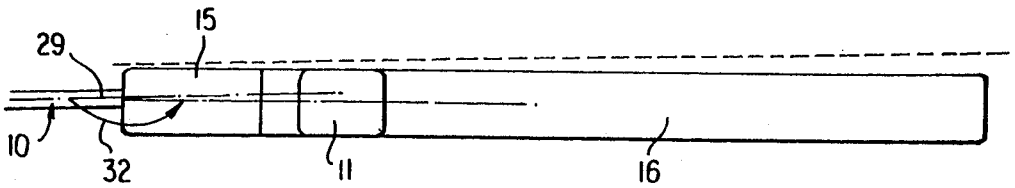
FIG. 12 is a top plan view corresponding to FIG. 8, but showing a modified embodiment of the second part of FIG. 5.

In a further alternative embodiment, illustrated in FIG. 12, the lateral friction bend is displaced into the shank 10 of the first part 9, which is correspondingly angled at the axis 29 near its point of connection to the second part 12. This results in an arrangement in which, similarly to the embodiment of FIG. 8, the longitudinal plane of symmetry of the portion of the shank 10 forward of the axis 29, and the longitudinal place of symmetry of the remainder of the shank 10 and the second part 12, enclose an obtuse angle 32 which is slightly less than 180°.

The lateral friction bend is thus either displaced into the shank 10 of the first part 9 which is correspondingly angled at 29 at the location of coupling, or the longitudinal groove 17 is provided in the housing portion 15 at a correspondingly oblique orientation. This results in a arrangement in which the longitudinal plane of symmetry of the shank 10 of the first part, projecting from the second part 12 and the lon-gitudinal plane of symmetry of the second part 12 enclose an obtuse angle 30 which is slightly less than 180°.

It is to be understood that while the preferred embodiments of the invention were described as forming part of a compound transfer needle, the invention may find application in other types of compound needles as well.

Figure 13:
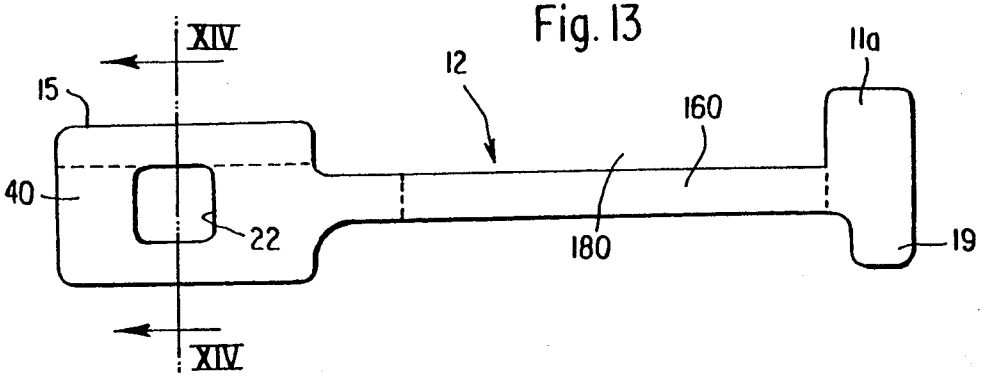
FIG. 13 is an enlarged side elevational view of the second part of the closing element of the compound transfer needle of FIG. 1, showing a modified embodiment of the second part of FIG. 5.
Figure 15:
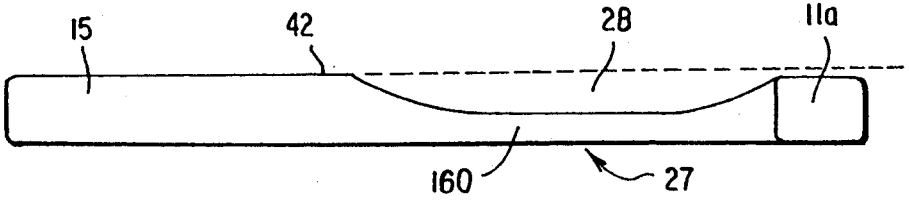
FIG. 15 is a top plan view of FIG. 13.
Figure 14:
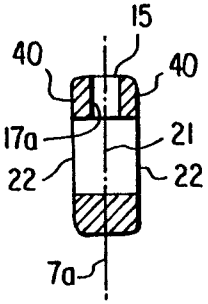
FIG. 14 is a sectional view along line XIV—XIV of FIG. 13.

As an alternative, to the previously described embodiments the closing element 7 can be provided with a control butt 11*a* that is located remote from the housing section 15. An embodiment of the closing element 7 that is modified in this way is shown in FIGS. 13 to 15. In this embodiment the control butt 11*a* is formed on a second shank 160 that extends between the housing section 15 and the guide member 19 that is disposed below the control butt 11*a*. The control butt 11*a* may be followed by a back shank similar to back shank 16 of FIG. 9.

In addition to this modification, FIGS. 13 and 14 show a housing section 15 in which a symmetrical longitudinal groove 17*a* is provided which opens upwards, as shown in FIG. 14 and extends rearwardly into a recess 180 in the second shank 160. The opening of the recess 180 is oriented upwards in FIG. 13 towards the upper side of the second part 12 and is delimited at the end of the second shank 160 by the control butt 11*a*. Apart from the before-mentioned modifications, the overall design of this modified second part is similar to the second part as shown in FIGS. 5 to 7 and alike reference numerals do designate alike elements.

The invention now being fully described, it will be apparent to one of ordinary skill in the art that any changes and modifications can be made thereto without departing from the spirit or scope of the invention a set forth herein.

What is claimed is:

1. A compound needle comprising:

(a) a needle member having a longitudinal direction and including a head; and (b) a longitudinally extending closing member mounted on said needle member so as to be displaceable with respect to said needle member in the longitudinal direction and so as to cooperate with said head, said closing member including (1) a first part having a shank, beard a tip on said shank, and a coupling means on an end region of said shank remote from said tip, and (2) a second part following said first part in the longitudinal direction, said second part having a control butt, a crank spring acting laterally with respect to the longitudinal direction, and receiving means for receiving at least said end region of said shank together with said coupling means; the first and second parts being rigidly connected together by said coupling means and said receiving means.

2. The compound needle as defined in claim 1, wherein said receiving means includes a longitudinal groove, said shank having an end region being fitted into said longitudinal groove.

3. The compound needle as defined in claim 2, wherein said second part has a top and a bottom, said second part having a recess directed toward one of said top and said bottom, said longitudinal groove extending at one end thereof into said recess.

4. The compound needle as defined in claim 2, wherein said coupling means includes an anchoring butt formed on said end region of said shank, said receiving means having a recess opening into said longitudinal groove and being shaped correspondingly to the shape of said anchoring butt, said anchoring butt being fitted into said recess of said receiving means.

5. The compound needle as defined in claim 4, further comprising a housing; said longitudinal groove and said recess of said receiving means being formed in said housing; said housing, said longitudinal groove and said recess of said receiving means together forming said receiving means.

6. The compound needle as defined in claim 5, wherein said control butt is disposed on said hosing.

7. The compound needle as defined in claim 4, wherein said second part has at least one lateral opening to at least one of said longitudinal groove and said recess of said receiving means.

8. The compound needle as defined in claim 7, wherein said lateral opening has an edge, said first part and said second part being rigidly connected to each other in a region of said edge.

9. The compound needle as defined in claim 8, wherein said first part and said second part are welded or soldered together.

10. The compound needle as defined in claim 8, wherein said second part and said anchoring butt include means for forming a form-locking connection between said anchoring butt and said second part.

11. The compound needle as defined in claim 10, wherein said first part and said second part are wedged together.

12. The compound needle as defined in claim 1, wherein said second part includes a shank, said control butt being formed on said shank of said second part.

13. The compound needle as defined in claim 12, wherein said brake spring includes at least one lateral friction bend of said shank of said second part.

14. The compound needle as defined in claim 13, wherein said of said second part in a region of said lateral friction bend, has a laterally disposed section of reduced thickness.

15. The compound needle as defined in claim 1, wherein said second part includes a back shank following said control butt.

16. The compound needle as defined in claim 15, wherein said brake spring includes a lateral friction bend at said back shank.

17. The compound needle as defined in claim 16, wherein said back shank, in a region of said lateral friction bend, has a laterally disposed section of reduced thickness.

18. The compound needle as defined in claim 1, wherein a portion of said shank of said first part projects from second part, said second part forming said brake spring and being connected to said portion of said shank of said first part so that respective longitudinal planes of symmetry of said portion of said shank of said first part and said second part intersect at an obtuse angle which differs from 180°.

19. The compound needle as defined in claim 1, wherein said second part has a thickness, at least in sections thereof, which is greater than a thickness of said first part.

20. The compound needle as claimed in claim 19, wherein the thickness of said second part, at least in said sections thereof, is the same as a thickness of said needle member.

21. A compound needle, comprising:

(a) a needle member having a longitudinal direction and including a head; and (b) a longitudinally extending closing member mounted on said needle member so as to be displaceable with respect to said needle member in the longitudinal direction and so as to cooperate with said head, said closing member including (1) a first part having a shank, a tip on said shank, and a coupling means on an end region of said shank remote from said tip, (2) a second part following said first part in the longitudinal direction, said second part having a control butt, and receiving means for receiving at least said end region of said shank together with said coupling means, the first part and the second part being rigidly connected with one another by said coupling means and said receiving means; and (3) a brake spring included in said first part and said second part; said brake spring acting laterally with respect to the longitudinal direction and including a lateral friction bend formed in said shank near said coupling means.

* * * * *